US009702221B2

(12) United States Patent
Hofman et al.

(10) Patent No.: US 9,702,221 B2
(45) Date of Patent: Jul. 11, 2017

(54) DOWNHOLE TOOLS WITH BALL TRAP

(71) Applicant: Peak Completion Technologies, Inc., Midland, TX (US)

(72) Inventors: Raymond Hofman, Midland, TX (US); William Sloane Muscroft, Midland, TX (US); Frank Victor De Lucia, Houston, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 416 days.

(21) Appl. No.: 14/211,864

(22) Filed: Mar. 14, 2014

(65) Prior Publication Data

US 2014/0318816 A1 Oct. 30, 2014

Related U.S. Application Data

(60) Provisional application No. 61/800,020, filed on Mar. 15, 2013.

(51) Int. Cl.
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC ..... E21B 34/14; E21B 23/00–23/14
See application file for complete search history.

(56) References Cited

U.S. PATENT DOCUMENTS 4,913,229 A * 4/1990 Hearn ..... E21B 17/06 166/156
6,102,060 A * 8/2000 Howlett ..... E21B 21/10 137/1
7,322,417 B2 1/2008 Rytlewski et al.
8,365,829 B2 * 2/2013 Kellner ..... E21B 23/02 166/193
8,863,853 B1 * 10/2014 Harris ..... E21B 23/004 166/318
9,382,790 B2 * 7/2016 Bertoja ..... E21B 23/04
2004/0163820 A1 * 8/2004 Bishop ..... E21B 34/14 166/373
2006/0011347 A1 1/2006 Reimert
2006/0243455 A1 * 11/2006 Telfer ..... E21B 21/103 166/386
2007/0272420 A1 11/2007 Reimert et al.
2014/0216761 A1 * 8/2014 Trinh ..... E21B 10/322 166/386
2014/0318815 A1 * 10/2014 Merron ..... E21B 34/14 166/386
2015/0159469 A1 * 6/2015 Purkis ..... E21B 23/04 166/373

(Continued)

*Primary Examiner* — Robert E Fuller
*Assistant Examiner* — Steven MacDonald

(57) ABSTRACT

The described embodiments relate to a downhole tool that can capture a ball in a trap to prevent both upwell and downwell movement of the ball. Further, certain embodiments described herein may prevent fluid from flowing past a captured ball in either the upwell or downwell directions. Ball and seat valves incorporating such ball trap assemblies can be used to create a bi-directional plug which prevents fluid flow in either direction when the ball trap is engaged with an appropriately configured ball.

16 Claims, 17 Drawing Sheets

(56) References Cited

U.S. PATENT DOCUMENTS

| | | | | |
|---|---|---|---|---|
| 2016/0032670 | A1* | 2/2016 | Webster | E21B 23/004 166/381 |
| 2016/0032697 | A1* | 2/2016 | Harris | E21B 43/12 166/373 |
| 2016/0040508 | A1* | 2/2016 | Webster | E21B 21/103 166/244.1 |

* cited by examiner

DOWNHOLE TOOLS WITH BALL TRAP

CROSS-REFERENCES TO RELATED APPLICATIONS

This original nonprovisional application claims priority to, and the benefit of, U.S. provisional application Ser. No. 61/800,020, filed Mar. 15, 2013 and which is incorporated by reference herein.

STATEMENT REGARDING FEDERALLY SPONSORED RESEARCH OR DEVELOPMENT

Not applicable.

BACKGROUND

In hydrocarbon wells, tools incorporating valve assemblies having a restrictor element, such as a ball or dart, and a seat element, such as a ball seat or dart seat, have been used for a number of different operations. Such valve assemblies prevent the flow of fluid past the assembly and, with the application of a desired pressure, can actuate one or more tools associated with the assembly.

One use for such remotely operated valve assemblies is in fracturing (or "fracing"), a technique used by well operators to create and/or extend one or more cracks, called "fractures" from the wellbore deeper into the surrounding formation in order to improve the flow of formation fluids into the wellbore. Fracing is typically accomplished by injecting fluids from the surface, through the wellbore, and into the formation at high pressure to create the fractures and to force them to both open wider and to extend further. In many case, the injected fluids contain a granular material, such as sand, which functions to hold the fracture open after the fluid pressure is reduced.

Multiple valve assemblies which incorporate ball-and-seat seals, each having a differently-sized ball seat and corresponding ball, are known in the art. Frac valves connected to ball and seat valve do not require the running of a shifting tool thousands of feet into the tubing string and are simpler to actuate than frac valves requiring such shifting tools. Such ball and seat valves are operated by placing an appropriately sized ball into the well bore and bringing the ball into contact with a corresponding ball seat. The ball engages on a sealing section of the ball seat to block the flow of fluids past the valve assembly. Application of pressure to the valve assembly causes the valve assembly to "shift", opening the frac sleeve.

Some valve assemblies are selected for tool actuation by the size of ball or other restrictor element introduced into the well. If the well or tubing string contains multiple ball seats, the ball must be small enough that it will not seal against any of the ball seats it encounters prior to reaching the desired ball seat. For this reason, the smallest ball to be used for the planned operation is the first ball placed into the well or tubing and the smallest ball seat is positioned in the well or tubing the furthest from the wellhead. The balls in such ball and seat valves are often free to travel back up the tubing (e.g. back toward the point in which the ball is inserted into the well) when pressure on the downstream side of the ball exceeds the pressure on the upstream side of the ball. Thus, these traditional valve assemblies limit the number of valves that can be used in a given tubing string because each ball size is only able to actuate a single valve. This arrangement allows for each ball to travel from the insertion point to its desired seat and then to be removed from the well by fluid flowing from the well back to the surface.

The described embodiments and invention as claimed relate to a downhole tool that can capture a ball in a trap to prevent both upwell and downwell movement of the ball. Further, certain embodiments described herein may prevent fluid from flowing past a captured in either the upwell or downwell directions. Ball and seat valves incorporating such ball trap assemblies can be used to create a bi-directional plug which prevents fluid flow in either direction when the ball trap is engaged with an appropriately configured ball.

BRIEF SUMMARY

The present invention provides a downhole tool having a ball trap that allows a ball to hold pressure applied in either the downwell or upwell directions. The ball trap is generally configured of two opposing ball seats. A first seat is configured to allow the ball to pass through an opening in such seat so that the ball may enter the ball trap. The ball engages the second seat, creating a fluid seal therewith and holding the ball in the trap against fluid flow originating upwell. If the fluid pressure below the ball exceeds the fluid pressure above the ball, the first seat then prevents the ball from travelling back to its origin and prevents fluid and fluid pressure from being communicated past the ball trap.

The first seat may be a split ring, such as a c-ring configured to expand when the ball engages the split ring from outside of the ball trap. Alternatively, the ball trap may be slidable within a tubing string in which the trap is located. The inner surface of the housing, a mandrel, other structures, or some combination therefore, adjacent the ball trap may have a tapered or similar surface which decreases an annular space between the ball trap and such surface. Posts or other protrusions connected to the first seat cause the split ring to contract to a size smaller than the diameter of the ball. Thus, the ball trap is "closed" by when the ball trap as shifted as a result of the ball engaging.

Ball traps according the present disclosure may contain ball seats of any style or configuration provided that a ball may pass into the ball trap from a desired direction and be held in the ball trap up to a desired pressure rating in each direction. It will be appreciated that the pressure ratings in the upwell and downwell directions may be different depending on the configuration of the opposing seats.

DETAILED DESCRIPTION OF VARIOUS EMBODIMENTS

Figure 1:
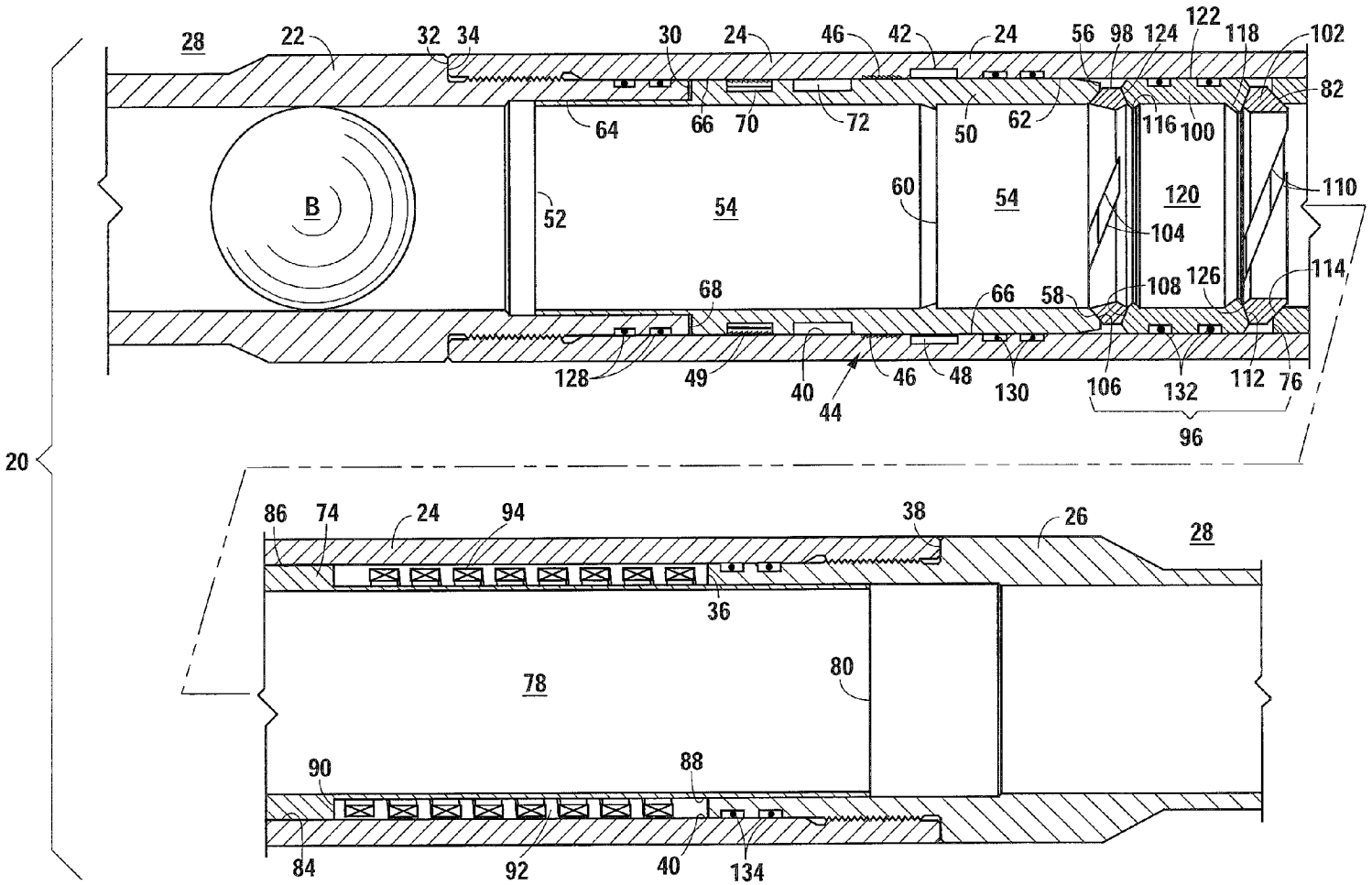
FIG. 1 is a side sectional view of a first embodiment of the present invention.

When used with reference to the figures, unless otherwise specified, the terms "upwell," "above," "top," "upper," "downwell," "below," "bottom," "lower," and like terms are used relative to the direction of normal production and/or flow of fluids and/or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracing process, fracing fluids and/or gasses move from the surface in the downwell direction to the portion of the tubing string within the formation. An inner diameter of an element may be referred to herein as an "ID." Similarly, an outer diameter of an element of may be referred to as an "OD." Finally, referring to an "inclination" refers to the angle of a surface from the longitudinal axis through the center of the tool.

The first embodiment 20 comprises a top connection 22, a housing 24 connected to the top connection 22, and a bottom connection 26 connected to the housing 24. The housing 24 may have a plurality of ports (not shown) disposed therethrough providing one or more fluid communication paths to an exterior 28 of the embodiment 20. The top connection 22 has an annular lower end surface 30 longitudinally positioned between an upper end surface 34 of the housing 24 and a lower end surface 38 of the housing 24. The bottom connection 26 has an upper annular end surface 36 longitudinally positioned between the upper and lower end surfaces 34, 38 of the housing 24.

The housing 24 has a generally cylindrical inner surface 40. A groove 42 is formed in and circumscribes the inner surface 40. A portion of the inner surface 40 defines a locking section 44 having annular ridges 46.

The embodiment 20 further comprises an upper inner sleeve 50 having an upper annular end surface 52, a cylindrical inner surface 54, and a lower annular end surface 56. A partially conical surface 58 is adjacent to the inner surface 54 and the lower annular end surface 56. An annular lip 60, or restriction, extends radially inward from the inner surface 54 and defines the smallest ID of the sleeve 50.

An outer surface 62 extends between, and is adjacent to, the upper and lower annular surfaces 52, 56. The outer surface 62 includes an cylindrical upper section 64 having a first OD and a cylindrical lower section 66 having a second OD that is greater than the first OD. An annular shoulder 68 separates the upper and lower sections 64, 66. The outer surface 62 defines first and second grooves 70, 72 that circumscribe the lower section 66.

A lock ring 48 in an expanded state partially occupies the groove 42 formed in the housing inner surface 40 and exerts a force radially-inward on the lower section 66 of the outer surface 62 of the sleeve 50. A ratchet ring 49 in a contracted state occupies the first groove 70 formed in the upper section 64 of the sleeve 50 and exerts a force radially-outward against the housing inner surface 40. When the ratchet ring 49 engages the locking section 44, upwell movement of the sleeve 50 is subsequently inhibited.

The embodiment 20 has lower inner sleeve 74 having an upper annular end surface 76, a cylindrical inner surface 78, and a lower annular end surface 80. A partially-conical surface 82 is adjacent to and between the upper annular end surface 76 and the inner surface 78. An outer surface 84 extends between the upper annular end surface 76 and the lower annular end surface 80. The outer surface 84 has an upper section 86 having a first OD and a lower section 88 having a second OD that is less than the first OD. The upper section 86 and lower section 88 are separated by an annular shoulder 90.

The lower inner sleeve 74, bottom connection 26, housing 24, and annular shoulder surface 90 define an annular volume 92 occupied by a high-compression spring 94, which is not compressed (or is only minimally compressed) in FIG. 1. More specifically, the annular shoulder 90, a portion of the housing inner surface 40, the upper annular surface 36 of the bottom connection 26, and the lower section 88 define the volume 92, which is variable insized and based upon the longitudinal position of the lower inner sleeve 74 relative to the housing 24.

A ball trap 96 is positioned within the housing 24 longitudinally between the annular lip 60 of the upper sleeve 50 and the shoulder 90 of the lower sleeve 74. The ball trap 96 comprises an upper split ring 98, a cylindrical ball carrier 100, and a lower split ring 102.

The upper split ring 98 has ends 104 defining a cut, which is preferably a scarf cut, that allows the upper split ring 98, upon application of a radially inward force, to contract into an annular body with the ends 104 in contact with one another. The upper split ring 98 has an upper partially-conical surface 106 that corresponds in inclination to the partially-conical surface 58 of the upper sleeve 50, and a lower partially-conical surface 108.

The lower split ring 102 has ends 110 defining a cut, which is preferably a scarf cut, that allows the lower split ring 102, upon application of a radially-inward force, to contract into an annular body with the ends 110 in contact with one another. The lower split ring 102 has an upper partially-conical surface 112, and a lower partially-conical surface 114 that corresponds in inclination to the partially-conical surface 82 of the lower sleeve 74.

In this embodiment, the upper and lower split rings 98, 102 are mirrors of one another, except that their respective scarf cuts are formed in the same direction. Scarf cuts are preferred because the angle of the cut relative to the axis around which the upper and lower split rings 98, 102 expand or contract extends the time in which the ends 104, 110, are in contact.

The ball carrier 100 is longitudinally positioned between the upper and lower split rings 98, 102 and has an upper annular restriction 116 and lower annular restriction 118. The ball carrier 100 includes a cylindrical inner surface 120 and a cylindrical outer surface 122. A partially-conical upper surface 124 corresponds in inclination to the partially-conical surface 108 of the upper split ring 98. A partially-conical lower surface 126 corresponds in inclination to the partially-conical surface 112 of the lower split ring 102.

Fluid flow through between the various elements is inhibited with sealing elements. A first pair of annular sealing elements 128 positioned radially between the top connection 22 and the housing 24. A second pair of annular sealing elements 130 is positioned radially between the upper sleeve 50 and the housing 24. A third pair of annular sealing elements 132 is positioned radially between the ball carrier 100 and the housing 24. A fourth pair of annular sealing elements 134 is positioned radially between the bottom connection 26 and the housing 24.

Operation of the embodiment is described with reference to a ball B migrating through the embodiment from the top connection 22 towards the bottom connection 26. The ball B is formed of any suitable material that will deform from its normal shape upon application of a pressure differential and then return to its shape when the differential is removed. The ball OD (under zero pressure differential) is equal to the ID of the cylindrical section 120 of the ball carrier 100.

Referring still to FIG. 1, the ball B is sized to easily flow through the top connection 22, the lower sleeve 74, and the bottom connection 26. Except for the lip 60, the ball B is sized to easily flow through the upper sleeve 50. The ball OD, however, is greater than the ID of the lip 60.

Figure 2:
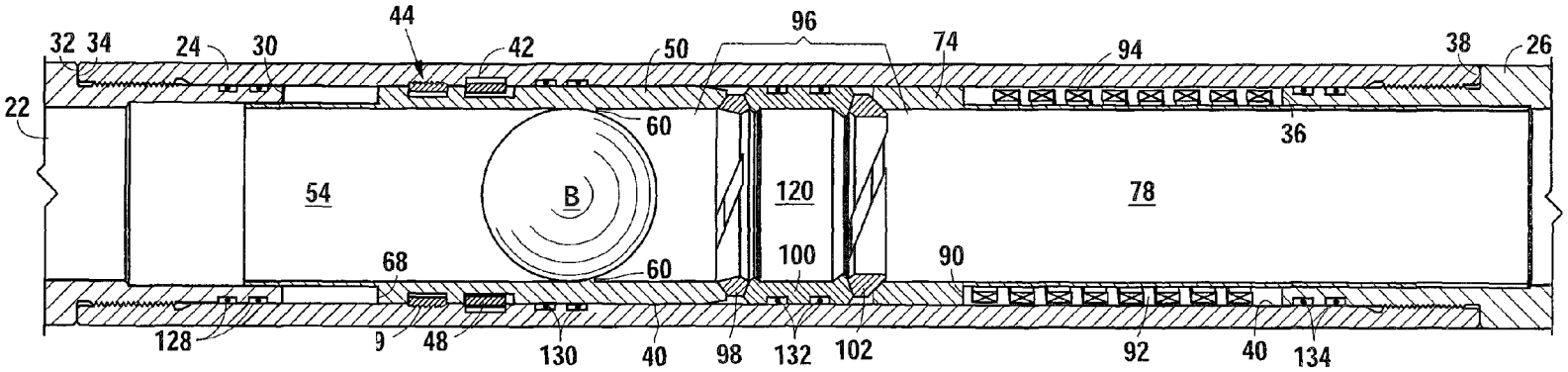
FIG. 2 is a partial side sectional view of the embodiment shown in FIG. 1 with the sleeve having moved downwell from the position shown in FIG. 1.

As shown in FIG. 2, under a downwell pressure the ball B migrates through the embodiment flow path to the annular lip 60, which has a smaller ID than the OD of the ball B under zero pressure differential. The ball B engages with and seals against the lip 60, and is inhibited from further downwell movement relative thereto.

Following engagement with the lip 60, continued pressure upwell of the ball B can be maintained, or increased if necessary, to move the upper sleeve 50 downwell. During such downwell movement, the upper sleeve 50 contacts the upper split ring 98, which contacts the ball carrier 100, which contacts the lower split ring 102, which contacts the lower sleeve 74 to apply a generally longitudinal downwell force against the spring 94. In FIG. 2, the upper sleeve 50 has moved to a second position in which the lock ring 48 is longitudinally aligned with the groove 42, which allows the lock ring 48 to radially contract into the groove 42. The ratchet ring 49 is longitudinally aligned with the locking section 44 of the housing inner surface 40, which inhibits upwell movement of the upper sleeve 50 relative to the housing 24. Thereafter, pressure may continue to be increased to extrude the ball B past the lip 60 and to the ball trap 96.

In FIG. 2, spring 94 is approximately 90% compressed. The expansive force of the spring 94 against the ball trap 96 urges the rings 98, 102 to radially contract by applying radially-inward forces to their respective partially conical surfaces.

Figure 3:
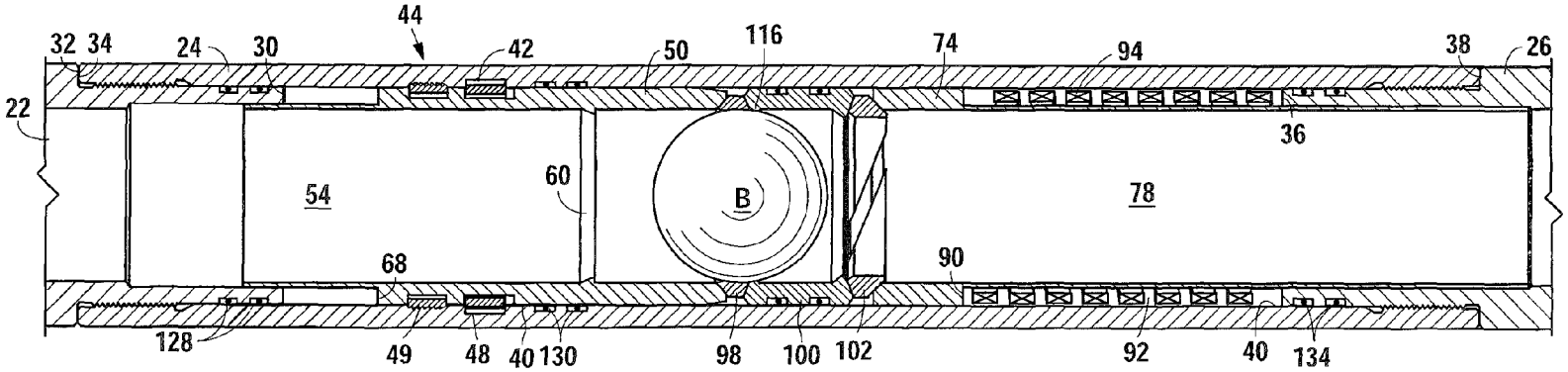
FIG. 3 is a partial side sectional view of the embodiment shown in FIG. 2, with the ball entering the ball trap of the embodiment.

Referring to FIG. 3, after extruding past the lip 60, the ball B engages with the upper split ring 98 and is inhibited from further downwell movement unless and until the pressure upwell of the ball B is increased to a pressure sufficient to cause radial expansion of the upper ring 98 sufficient to allow the ball B to pass through. Radial expansion of the upper split ring 98 also requires that the spring 94 be further compressed relative to the spring state shown in FIG. 2. After the ball B passes through the upper split ring 98, the split ring 98 radially contracts to its previous state shown in FIG. 2. The ball B must be extruded past the upper restriction 116 of the ball carrier 100, as the OD of the ball B is larger than the smallest ID of the upper restriction 116.

Figure 4:
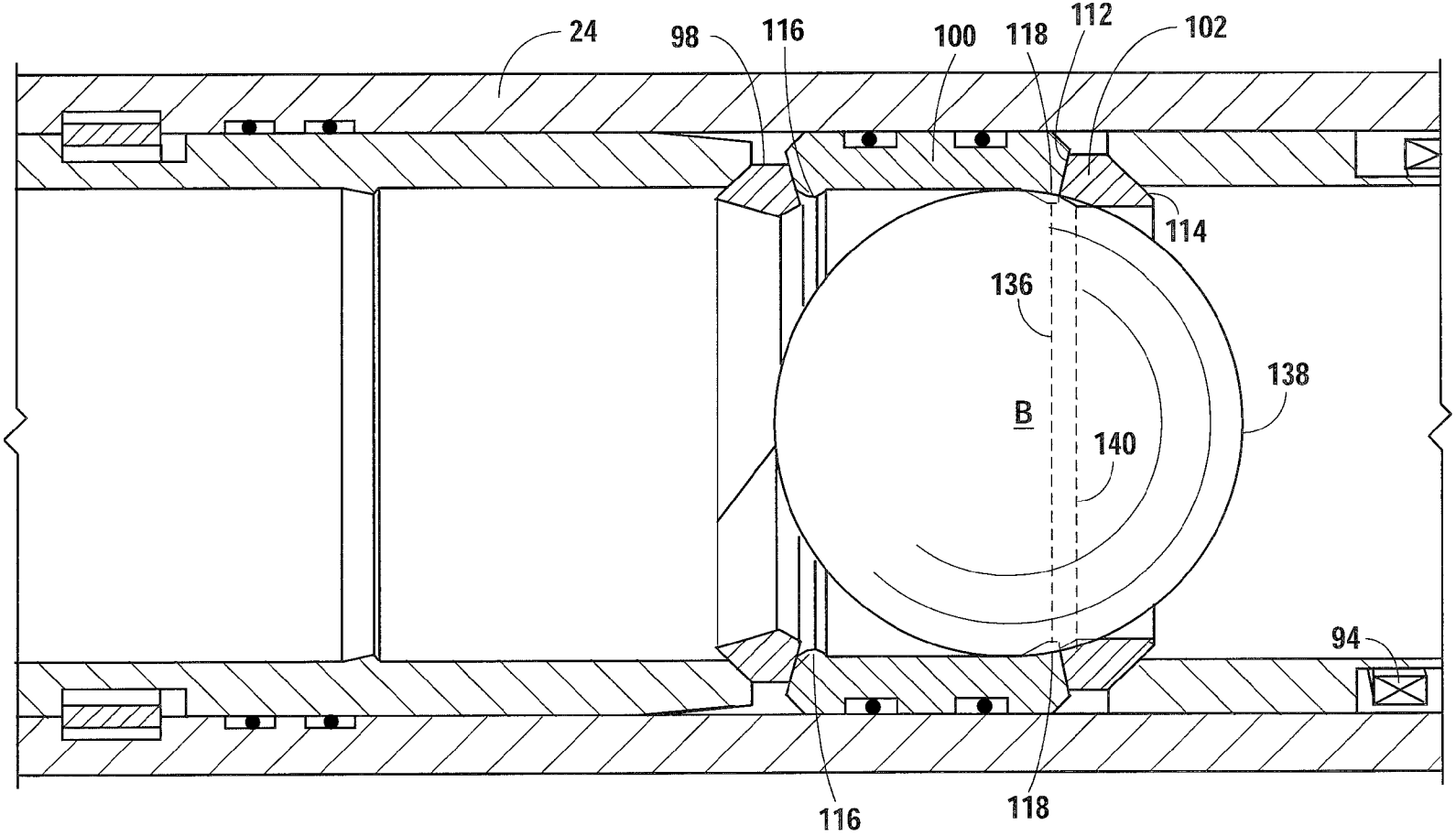
FIG. 4 is an enlarged view of the ball trap of the embodiment shown in FIG. 3, with ball making contact with the lower restriction of the ball carrier and the lower ring.

FIG. 4 shows the ball B with its center of mass longitudinally positioned between the upper and lower split rings 98, 102 and radially within the ball carrier 100. In this position, the ball B is free to move minimally (e.g., a distance less than the ball OD) in either the upwell or downwell direction to contact the upper split ring 98 or lower spit ring 102, respectively. The ball OD is larger than the smallest ID of the upper ring 98 and the smallest ID of the lower ring 102 (which in this embodiment are the same value). The ball OD is larger than the smallest ID of the lower restriction 118, which is smaller than the ID of the upper restriction 116, such that that ball B cannot extrude through the lower restriction 118, even under increasing pressure.

FIG. 4 shows the ball B seated against the lower restriction 118 and the lower split ring 102 to inhibit downwell fluid flow, such as when a downwell pressure is applied after the ball B has entered the ball carrier 100. In this position, the lower restriction 118 provides a first ring of contact 136 against the outer surface 138 of the ball B. Application of pressure causes the ball carrier 100 to move downwell relative to the housing 24 against the expansive force of the spring 94, which is already substantially compressed. Because of the inclination of the surfaces 112, 114 the lower ring 102 is longitudinally "squeezed" and urged to radially contract and close the scarf cut to provide a second ring 140 of contact on the outer surface 138 of the ball B. Increasing the pressure above the ball increases the magnitude of the radially-inward force exerted on the ball B by the lower ring 102 as the expansive force of the spring 94 increases pursuant to Hooke's law, until ultimately the applied pressure causes the ball B to fail structurally.

Figure 5:
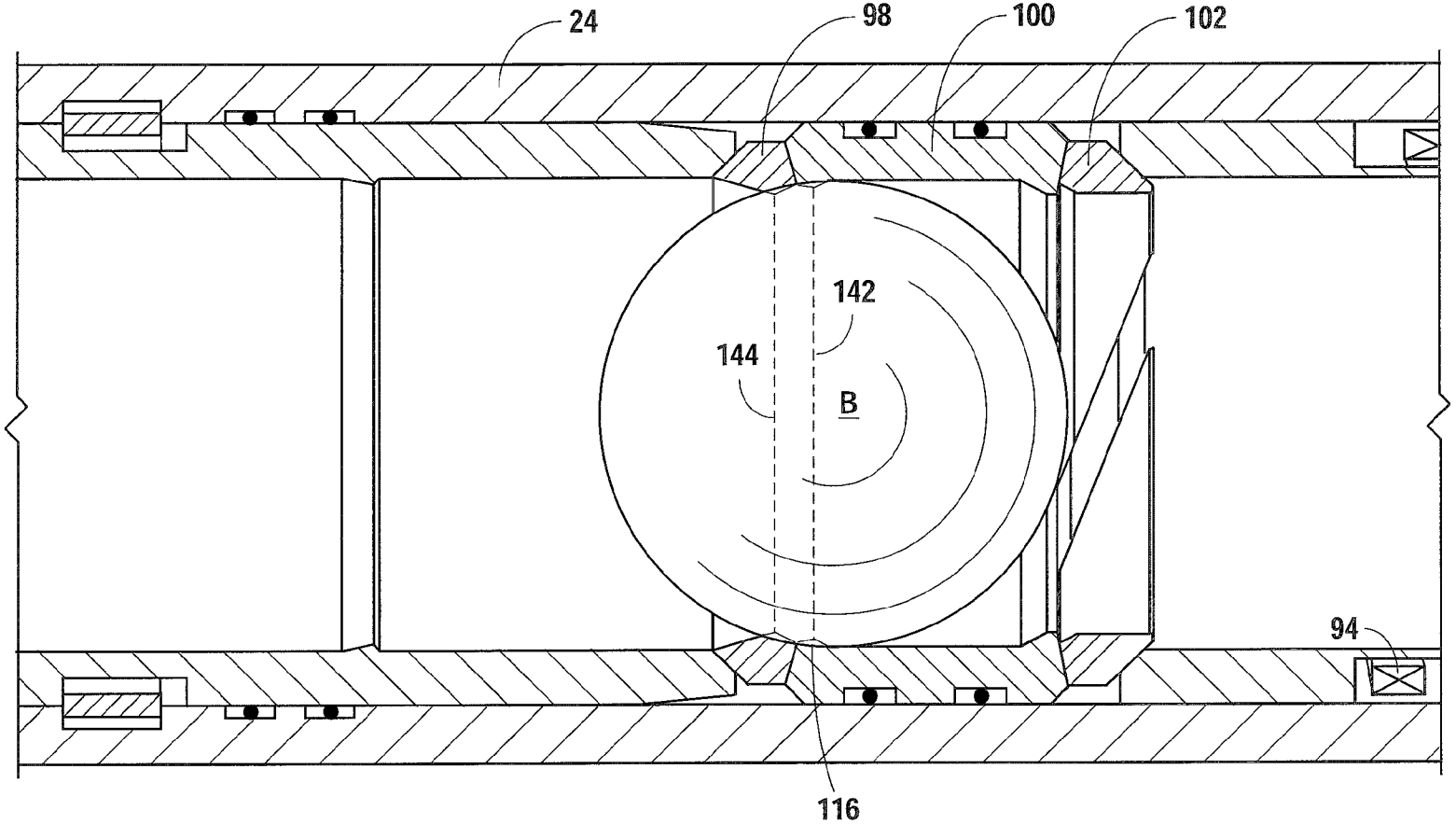
FIG. 5 is the same as FIG. 4, except showing the ball engaging with the upper ring and lower restriction of the ball carrier.

FIG. 5 shows the ball B seated against the upper restriction 116 of the ball carrier 100 and the upper split ring 98 to inhibit upwell fluid flow, such as when an upwell pressure is applied below the ball B. In this instance, the expansive force of the spring 94 has already caused the upper split ring 98 to contract prior to the ball B seating against the upper restriction 116. The upper restriction 116 provides a first ring 142 of contact. When ball B contacts the upper restriction 116 under an upwell pressure, the ball carrier 100 is moved upwell, urging the upper ring 98 to radially contract and increasing the forces of contact on the ball in a second ring 144 of contact.

Figure 6:
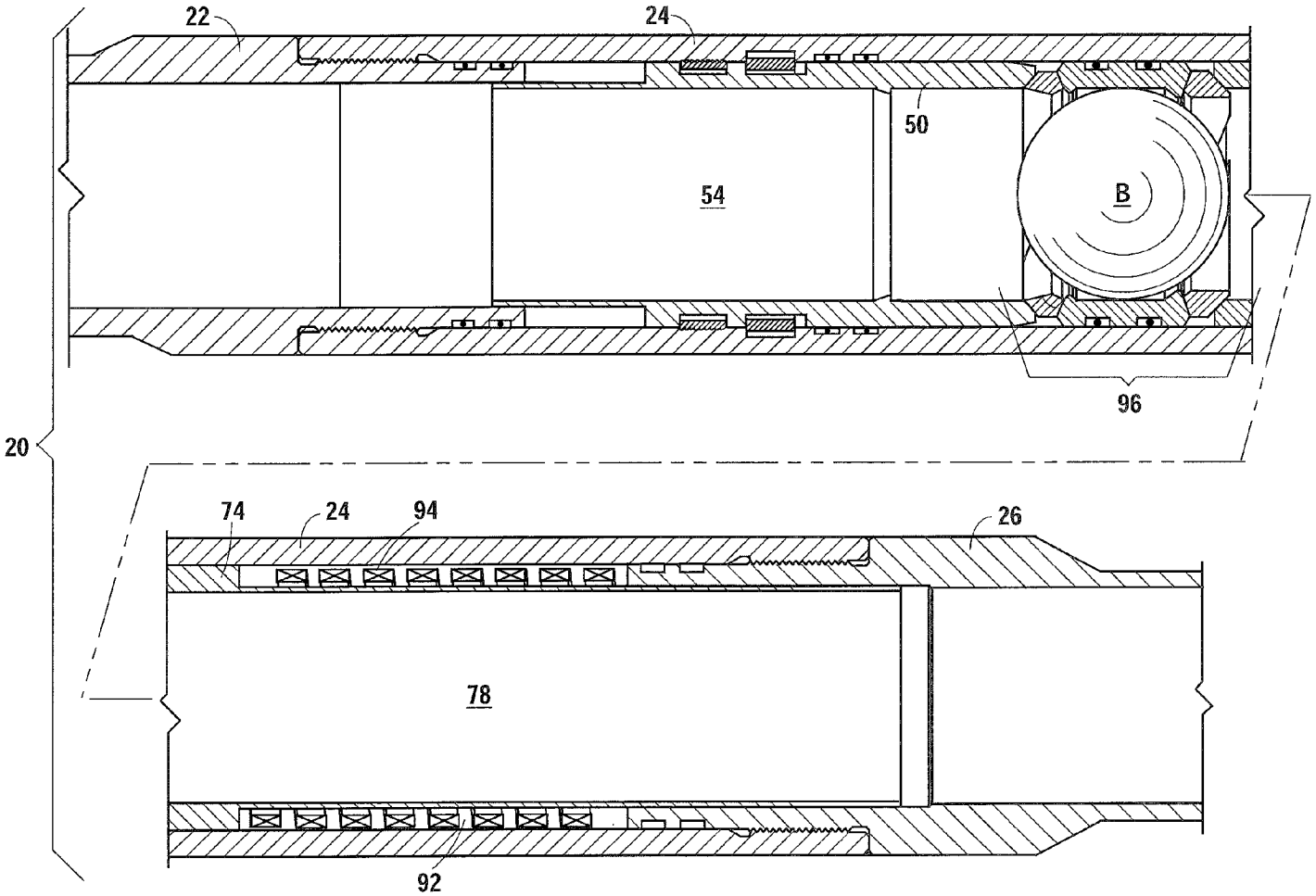
FIG. 6 is a side sectional view of the first embodiment with the ball positioned in the ball trap.

FIG. 6 shows the embodiment 20 after the sleeve 50 has been moved downwell to a second position. The ball B is contained by the ball trap 96.

Figure 7:
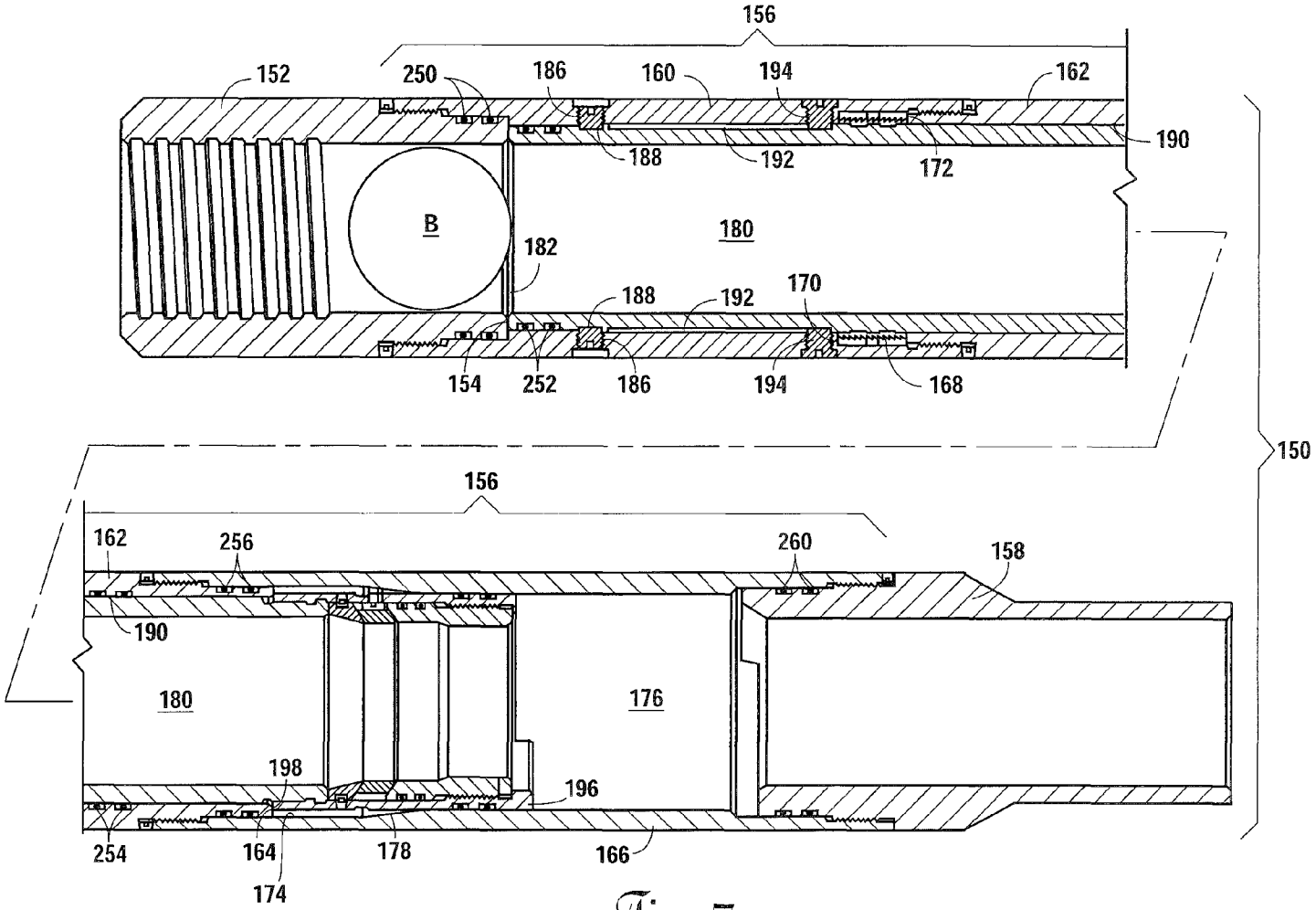
FIG. 7 is a side sectional view of a second embodiment of the invention.

FIG. 7 shows another embodiment 150 of the invention, which has a top connection 152 with a lower annular surface 154, a housing assembly 156 connected to the top connection 152, and a bottom connection 158 connected to the housing assembly 156. The housing assembly 156 includes a ported housing 160 with a plurality of ports P (not shown) disposed therethrough and an annular surface 170, a seal housing 162 having a lower annular surface 164 and an upper annular surface 172, connected to the ported housing 160, and a lower housing 166 connected to the seal housing 162. The ported housing 160 is connected to the top connection 152. The bottom connection 158 is connected to the lower housing 166. Alternatively, the housing assembly 156 may include only one housing member. A lock housing 168 is longitudinally positioned between an annular surface 170 of the ported housing 160 and an upper annular surface 172 of the seal housing 162.

The lower housing 166 has a first inner surface 174 having a first ID, a second inner surface 176 having a second ID that is smaller than the first ID and positioned below the first inner surface 174, and a partially-conical surface 178 adjacent to and longitudinally between the first inner surface 174 and the second inner surface 176.

A tubular sleeve 180 is radially within the housing assembly 156. The sleeve 180 has an upper annular surface 182 adjacent to the lower surface 154 of the top connection 152, a lower annular surface 184, and an outer surface 196. The sleeve 180 is held in a fixed position relative to the ported housing 160 with a plurality of circumferentially-aligned shear pins 186 disposed through the ported housing 160 into corresponding recesses 188 in the outer surface 190 of the sleeve 180. A number of longitudinal slots 192 are formed in the outer surface 190 of the sleeve 180, into which are disposed a plurality of torque pins 194 to inhibit rotation of the sleeve relative to the housing assembly 156. The outer surface 190 of the sleeve 180 between the sidewalls forming slots 192 is ridged to engage the inner surface the latch ring 173 within the lock housing 168.

Figure 8:
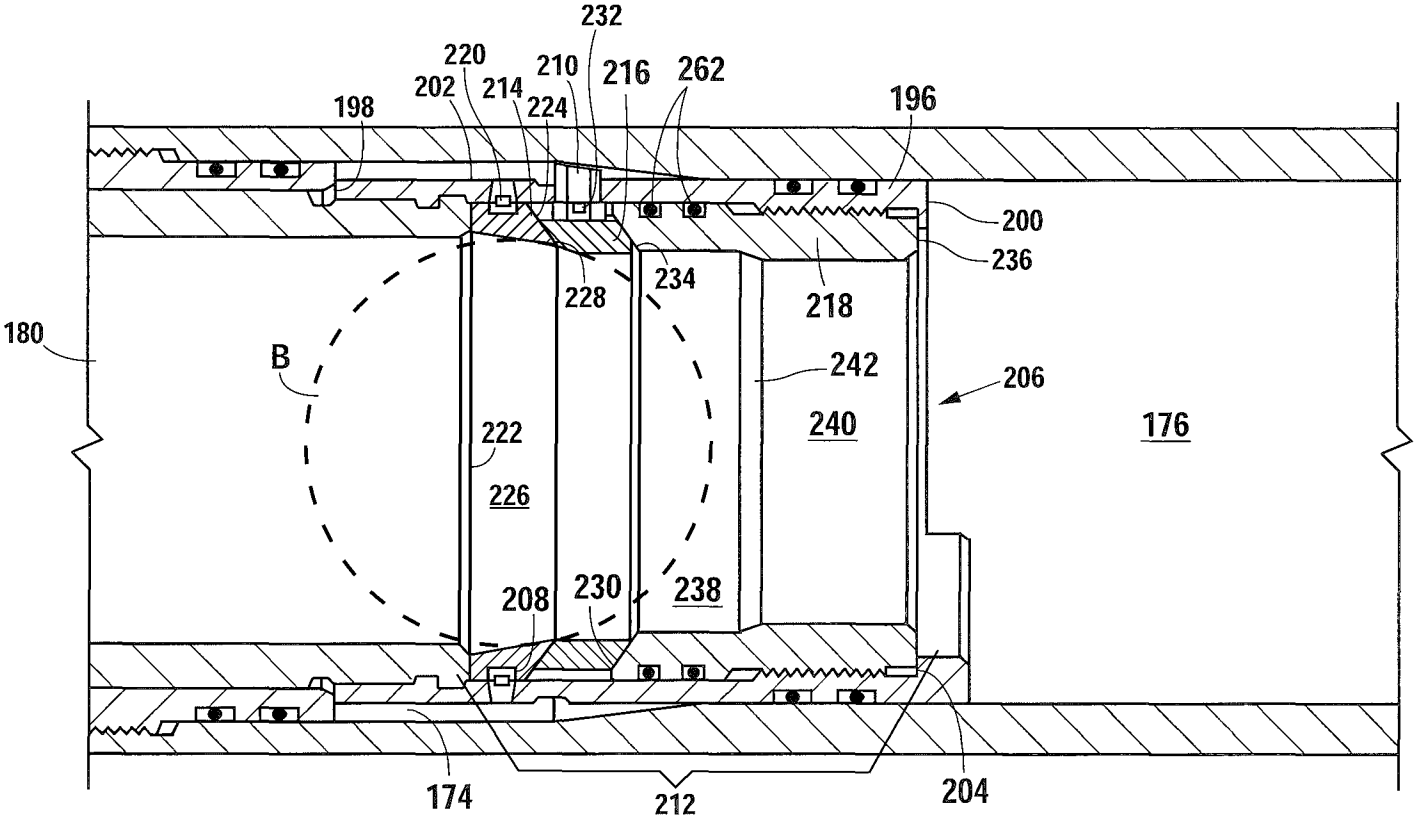
FIG. 8 is a partial side sectional view showing the ball trap of the second embodiment in greater detail.

Referring to FIG. 8, tubular ball carrier 196 is threaded around the lower end of the sleeve 180. The ball carrier 196 has an upper annular surface 198, a lower annular surface 200, and an outer cylindrical surface 202 with a generally-uniform outer diameter. The lower annular surface 200 extends radially inward to form an annular shoulder surface 204 defining a lower opening 206. A slot 208 is formed in the ball carrier 196 that partially circumscribes the carrier body. A compression ring 210 is positioned in the slot 208.

A ball trap 212 comprising an upper seat 214, a C-ring 216, and a lower seat 218 is within the ball carrier 196. The upper seat 214 is connected to the ball carrier 196 with a fastener 220. The upper seat 214 has an annular upper surface 222 adjacent to the lower surface 184 of the sleeve 180, and a partially-conical lower surface 224. The upper seat 214 further has a partially-conical inner surface 226 extending between the upper surface 222 and lower surface 224, with the ID of the inner surface 226 proximal to the upper annular surface 222 greater than the ID of the inner surface 226 proximal to the lower surface 224.

The C-ring 216 has a partially-conical upper surface 228 corresponding in inclination to the lower surface 224 of the upper seat 214, and a partially-conical lower outer surface 230. The C-ring 216 is fixed to the compression ring 210 with fastener 232.

The lower seat 218 is threaded to the ball carrier 196 and has partially-conical upper surface 234 and an annular lower surface 236 adjacent to the annular shoulder 204. The lower seat 218 has an upper section 238 having a first ID, and a lower section 240 having a second ID smaller than the first ID. The upper section 238 and lower section 240 are separated by a partially-conical surface 242.

Still referring to FIG. 8, the compression ring 210 is expanded against the first upper surface 174 of the lower housing 166, which allows the ID of the C-ring 216 to be equal to or greater than the smallest ID of the upper seat 214 and the ID of the upper section 238 of the lower seat 218.

Operation of the embodiment 150 is described with reference to a ball B initially moving in the downwell direction. Without a pressure differential across the ball B, ball B has an OD sized to fit within the top connection 152 and inner sleeve 180. The ball OD is equal to or smaller than the smallest ID of the upper seat 214, equal to or smaller than the ID of the C-ring 216, and equal to or smaller than (in this embodiment, "equal to") the first ID of the lower seat 218. The ball OD is larger than the second ID of the lower seat 218.

Figure 9:
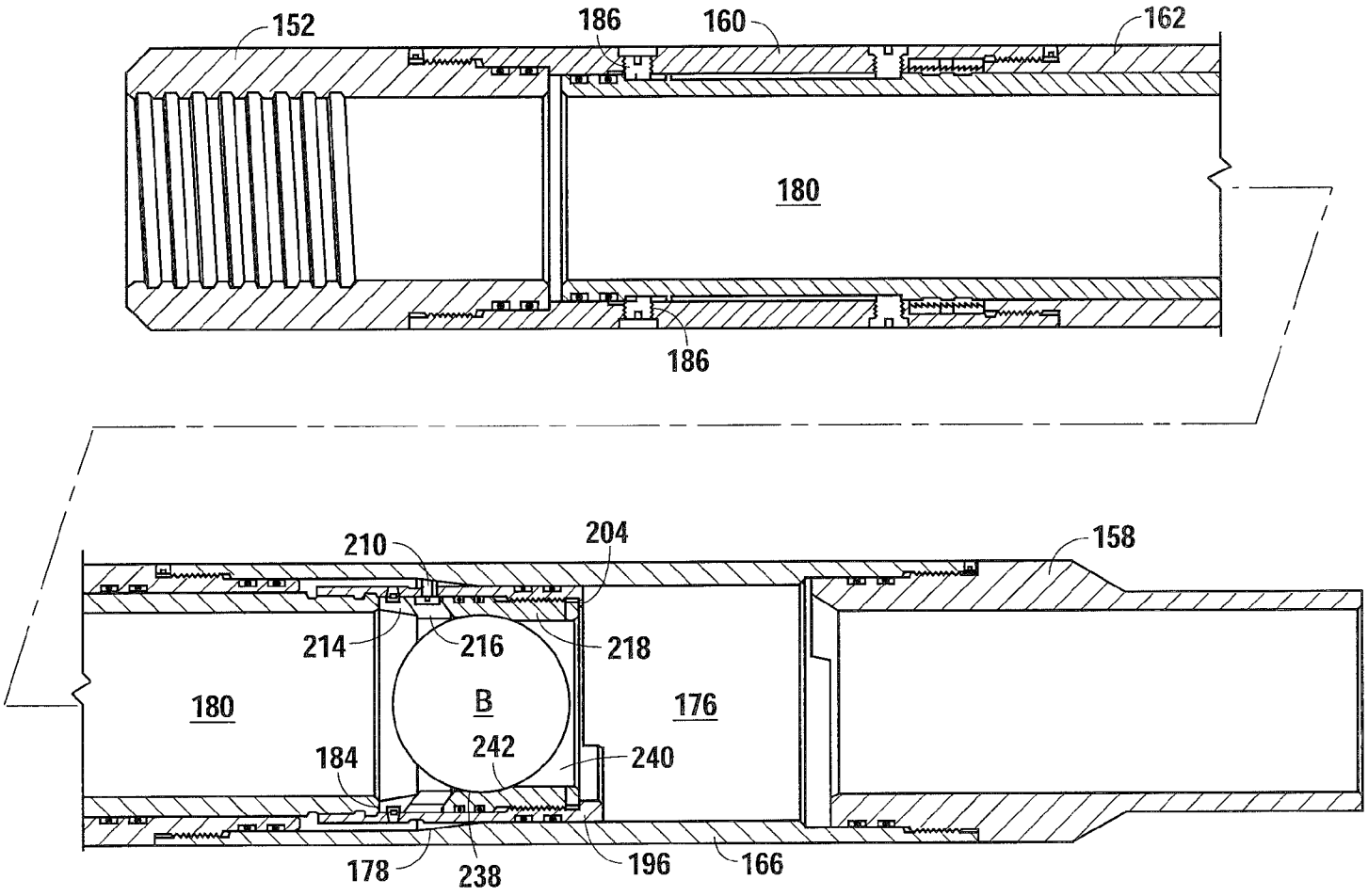
FIG. 9 shows a ball having entered the ball trap of the second embodiment.
Figure 10:
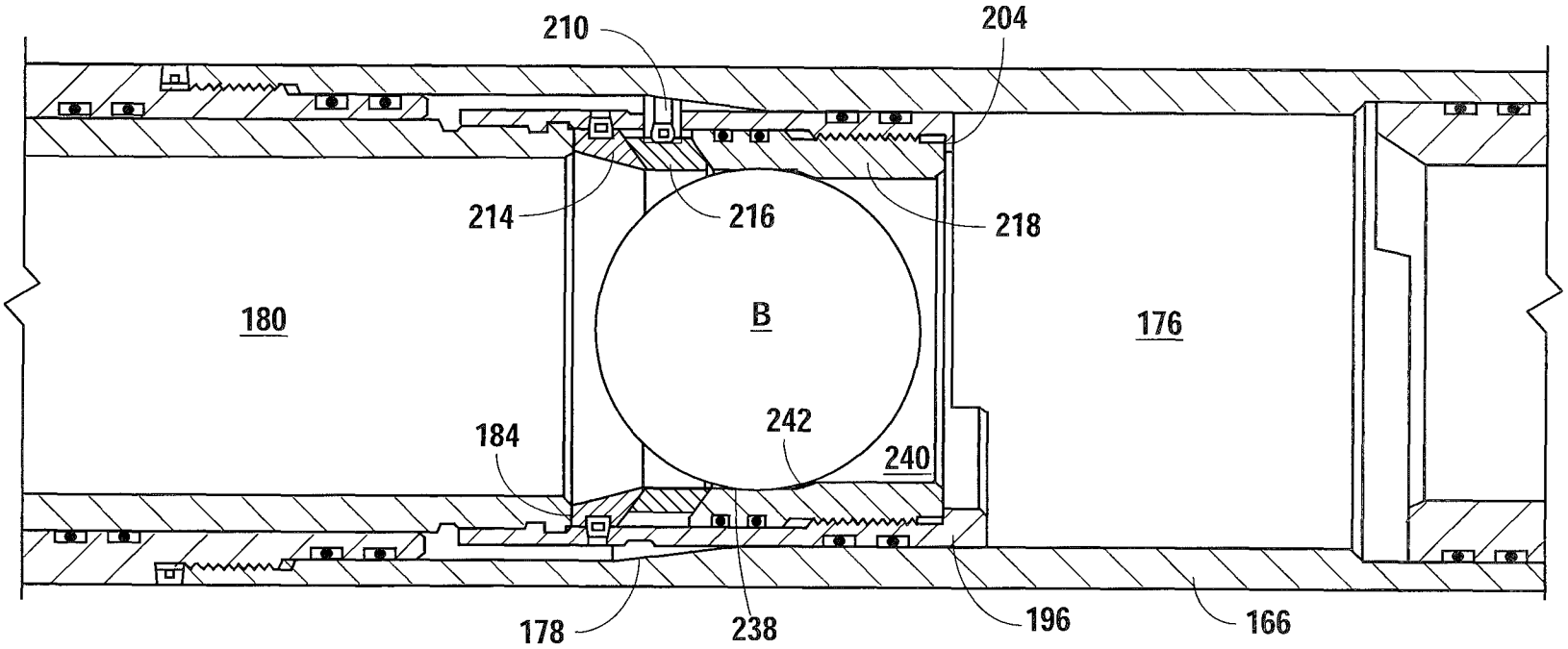
FIG. 10 is an enlarged view of the ball and ball trap shown in FIG. 9.

FIGS. 9-10 show the ball B having entered the lower seat 218 and seated against its inner surfaces 238. More specifically, the ball B contacts the junction between the partially-conical surface 242 and the lower section 240. In this position, downwell fluid flow past the ball B is inhibited and allows a well operator to increase the pressure above the ball B to a pressure sufficient to fracture the shear pins 186.

After the shear pins 186 are fractured, the sleeve 180 is free to move relative to the housing 160. Downwell movement of the sleeve 180 forces downwell movement of the ball carrier 196, which causes downwell movement of the upper seat 214, C-ring 216, and lower seat 218, as they are longitudinally positioned between the lower surface 184 of the sleeve 180 and the shoulder 204 of the ball carrier 196 as shown in FIG. 10. As the ball carrier 196 moves downwell, the compression ring 210 is caused to radially contract by contact with the partially-conical surface 178 of the lower housing 166.

Figure 11:
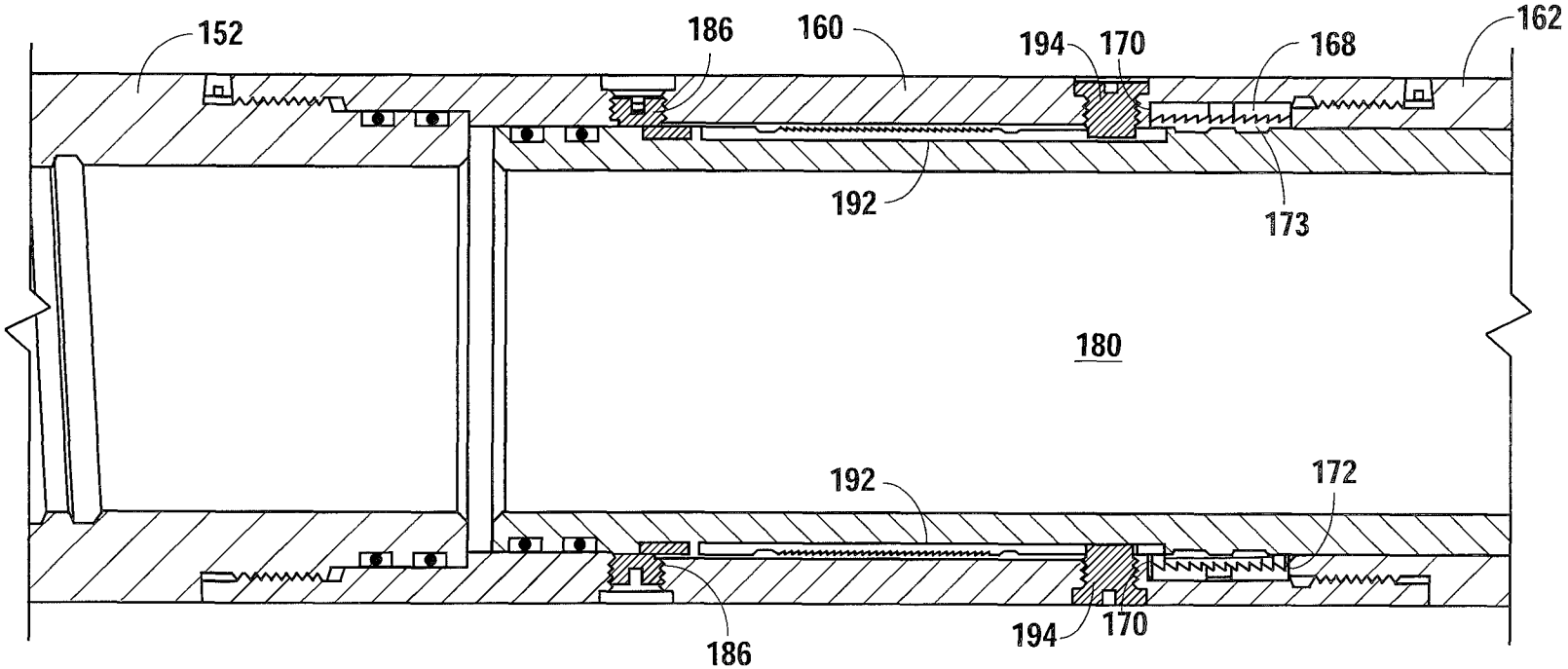
FIG. 11 shows the lock housing of the second embodiment.

FIG. 11 is an enlarged view showing the slots 192, torque pins 194, ridged outer surfaces of the sleeve 180, and the lock housing 168 in greater detail. The lock housing 168 is longitudinally positioned between an annular surface 170 of the ported housing 160 and the upper end surface 172 of the seal housing 162. An intermediate lock ring 173 is nested within the lock housing 168 having outer teeth engaged therewith and inner ridges for engagement with the ridged outer surfaces of the sleeve 180 when it moves to the position shown hereafter in FIG. 14. In FIG. 11, the shear pins 186 have fractured and the sleeve 180 has moved downwell from the position shown in FIG. 7.

Figure 12:
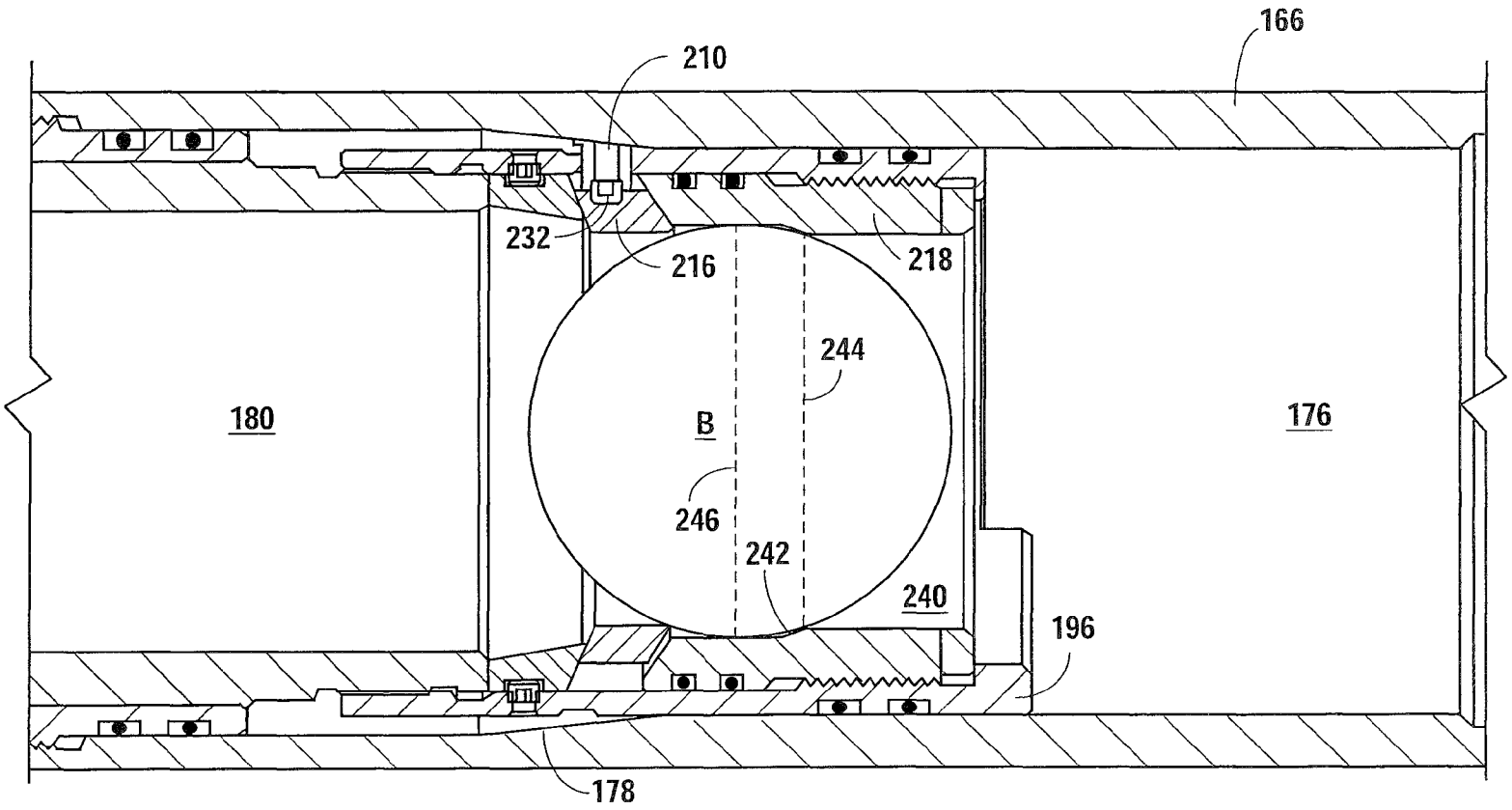
FIGS. 12-13 show the C-ring of the second embodiment engaging the upper side of the ball.
Figure 13:
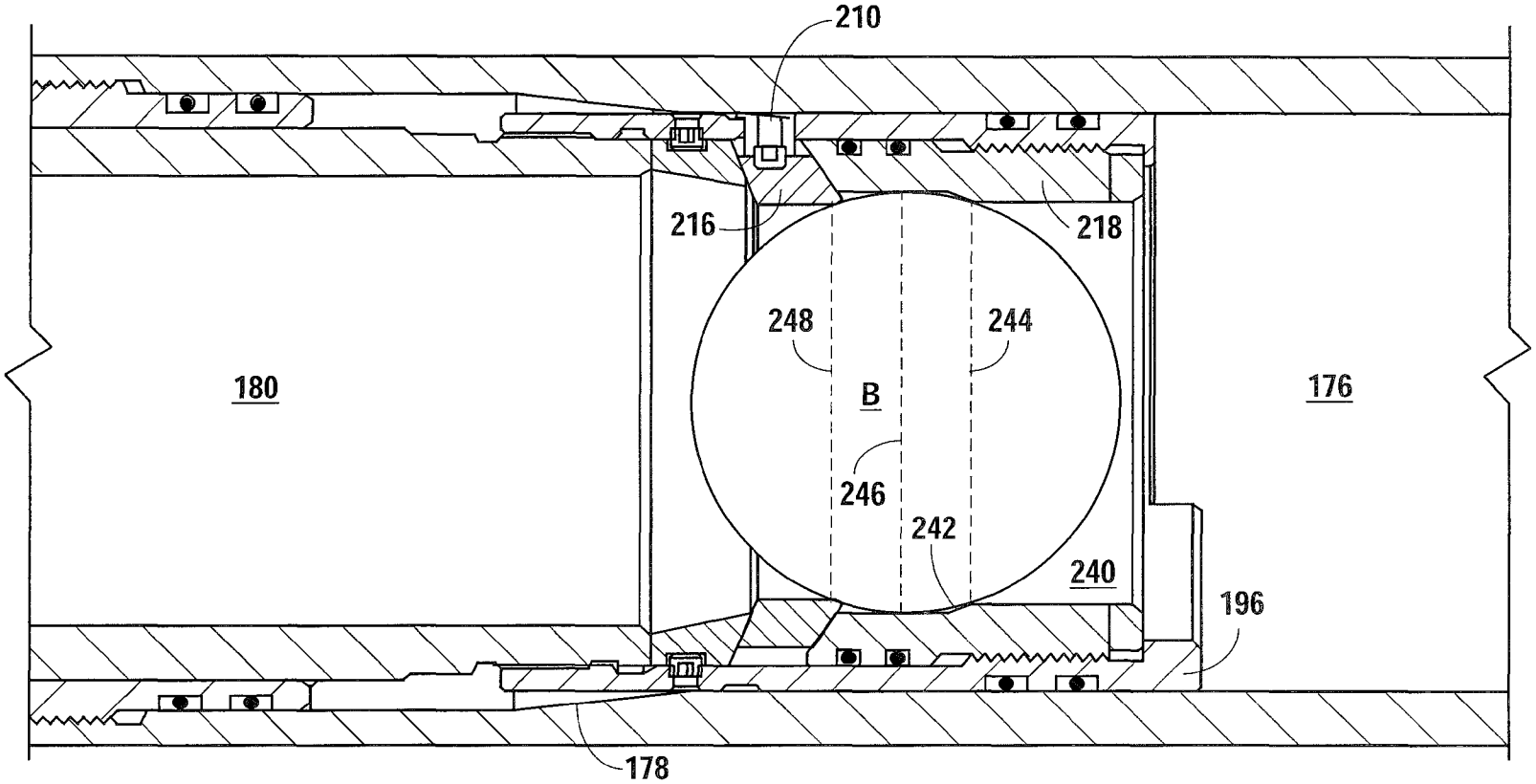

As shown in FIGS. 12-13, as the ball carrier 196 moves to a position adjacent to the bottom connection 158 (not shown), the compression ring 210 is nested within the lower inner surface 176 of the lower housing 166, which in turn forces the C-ring 216 to radially contract around the upper half of the ball B. In this position, the embodiment engages the ball B with three rings of contact: a lower ring 242 at the junction of the partially cylindrical surface 242 and the lower section 240, an intermediate ring 246 at upper section 238, and an upper ring 248 at the C-ring 216 that inhibits upwell movement of the ball B if an upwell pressure is applied.

Figure 14:
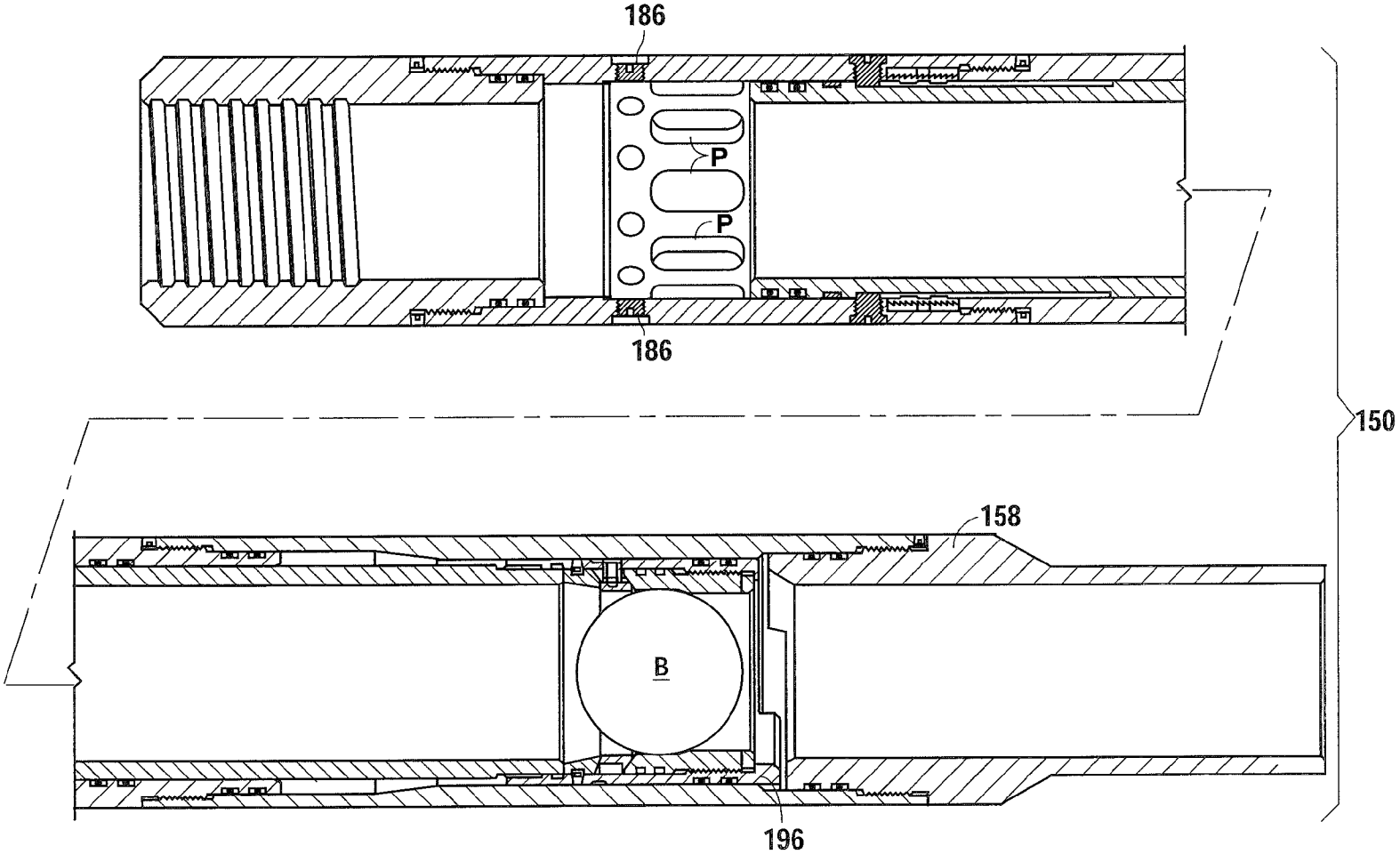
FIG. 14 shows the ports establishing a communication path to the interior flowpath of the second embodiment.

FIG. 14 shows the embodiment 150 after the ball carrier 196 has been moved downwell to a position adjacent to the bottom connection 158. The upper end surface 182 of sleeve 180 is downwell of the ports P, which are downwell of the shear the pins.

Referring back to FIG. 7, a number of sealing elements are interposed between the various elements to inhibit fluid flow therebetween. A first pair of sealing elements 250 is radially positioned between the top connection 152 and the ported housing 160. A second pair of sealing elements 252 is radially positioned between the sleeve 180 and the ported housing 160 longitudinally between the shear pin recesses 188 and the upper annular surface 182 of the sleeve 180, and moves with the sleeve 180. A third pair of annular sealing elements 254 is radially positioned between the sleeve 180 and the seal housing 162. A fourth pair of sealing elements 256 is positioned between the seal housing 162 and the lower housing 166. A fifth pair of sealing elements 258 is positioned between the ball carrier 196 and the lower housing 166, and moves with the ball carrier 196. A sixth pair of sealing elements 260 is positioned between the bottom connection 158 and the lower housing 166. As shown in FIG. 8, a seventh pair of sealing elements 262 is positioned between the lower seat 218 and the ball carrier 196.

Figure 15:
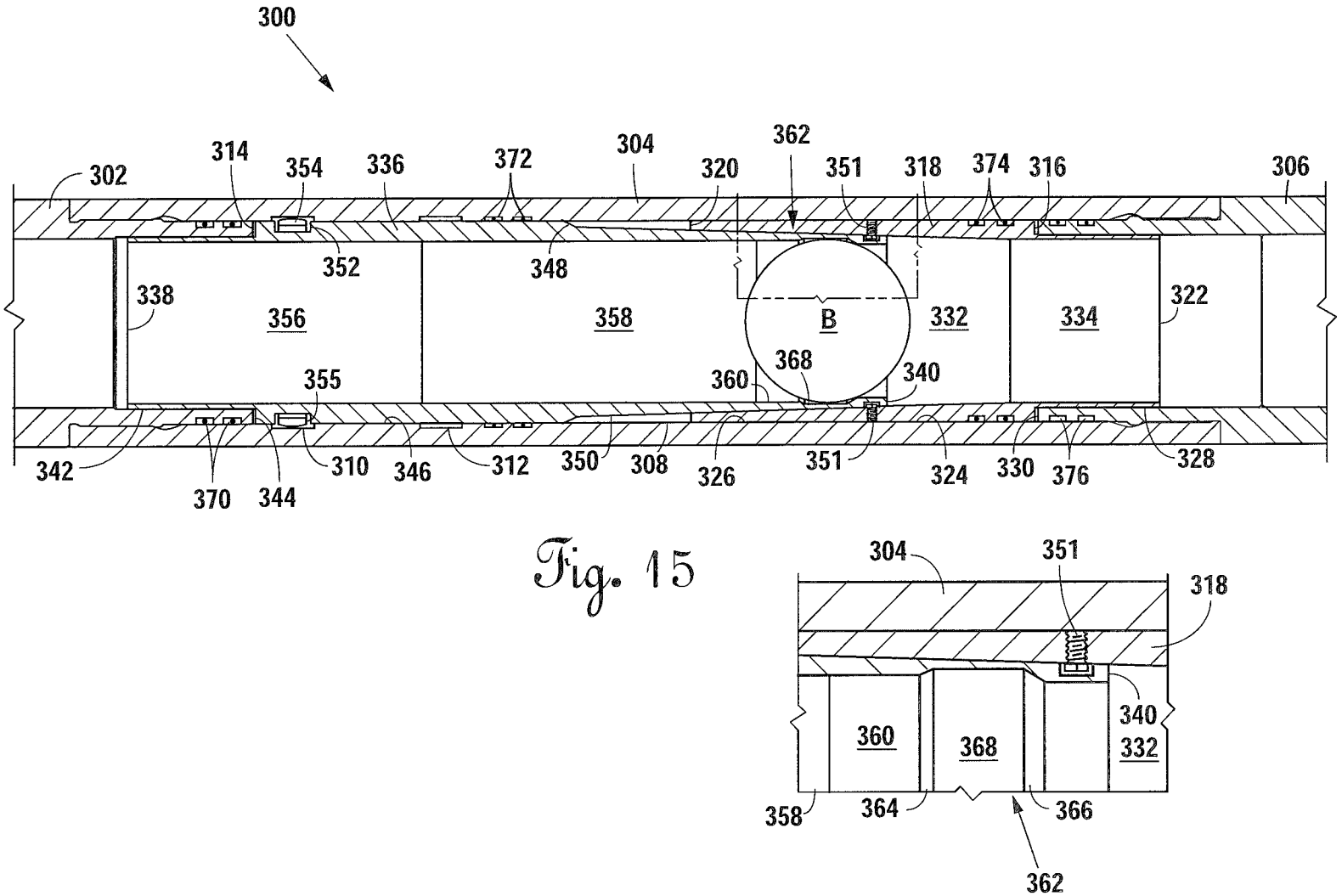
FIG. 15 is a side section view of a third embodiment.

FIG. 15 shows yet another embodiment 300 of the invention, which has a top connection 302, a housing 304 connected to the top connection 302, and a bottom connection 306 connected to the housing 304. The housing 304, which may be ported, has a generally cylindrical inner surface 308 that forms a first annular groove 310 and a second annular groove 312 circumscribed therein. The top connection 302 has a lower annular end surface 314. The bottom connection 306 has an upper annular end surface 316.

The embodiment 300 comprises a lower tubular member 318 having an upper annular end surface 320, a lower annular end surface 322, and an outer surface 324 adjacent to and between the upper surface 320 and lower surface 322. The outer surface 324 has a first section 326 having a first OD and a second section 328 having a second OD that is smaller than the first OD, and forms an annular shoulder 330 positioned longitudinally between the upper surface 320 and lower surface 322 and adjacent to the upper annular end surface 316 of the bottom connection 306. The lower tubular member 318 has a partially-conical inner surface 332 adjacent to a cylindrical inner surface 334.

The embodiment 300 further comprises an upper sleeve 336 having an upper annular end surface 338, a lower annular end surface 340 radially within the lower tubular member 318, and outer surfaces extending between the upper end surface 338 and the lower end surface 340. The outer surfaces include a first cylindrical surface 342 adjacent to the upper surface 338, an annular shoulder surface 344 adjacent to the first cylindrical surface 342, a second cylindrical surface 346 adjacent to the shoulder surface 344, a first partially-conical surface 348 adjacent to the second cylindrical surface 346, and a second partially-conical surface 350 adjacent to and between the first partially-conical surface 348 and the lower end surface 340. The upper sleeve 336 is fixed to the lower member with a plurality of shear pins 351.

A groove 352 is formed in and circumscribes the second cylindrical surface 346 of upper sleeve 336 and is longitudinally aligned with the first groove 310 of the housing 304. A ratchet ring 354 partially occupies both the first groove 310 and the groove 352 in the surface 346. The ratcheting 354 has a beveled lower surface 355.

The sleeve 336 further has a number of inner surfaces that extend between the upper end surface 338 and the lower end surface 340, and include a cylindrical inner surface 356, a tapering or partially-conical surface 358 adjacent to the cylindrical inner surface 356, a second cylindrical surface 360 adjacent to the partially-conical inner surface 358, a ball trap 362 formed by upper and lower partially-conical surfaces 364, 366, and an intermediate cylindrical surface 368.

A number of sealing elements are interposed between the various elements to inhibit fluid flow therebetween. A first pair of sealing elements 370 is radially positioned between the top connection 302 and the housing 304. A second pair of sealing elements 372 is radially positioned between the upper sleeve 336 and the housing 304. A third pair of annular sealing elements 374 is radially positioned between the lower tubular member 318 and the housing 304. A fourth pair of sealing elements 374 is positioned between the bottom connection 306 and the housing 304.

Operation of the embodiment 300 is described with reference to a ball B migrating through the tool in the downwell direction. The ball OD is chosen so as to flow unabated through the top connection 302 and the first cylindrical surface 356 of the upper sleeve 336, but is larger than the smallest ID of the partially-conical surface 358. In addition, the ball OD is larger than the smallest ID of the lower partially-cylindrical surface 366 composing the ball trap 362. Preferably, the ball OD is equal to the ID of the intermediate cylindrical surface 368.

As pressure upwell is increased, the ball B migrates into the trap 362 and seats against the lower partially-conical surface 366. Continued application of pressure thereafter fractures shear pins 351 and forces the beveled edge 355 of the ratchet 354 against the sidewall of the housing groove 310 and causes the ratchet 354 to radially contract from the groove 310. Thereafter, the sleeve 336 is moveable downwell relative to the housing 304, which causes an application of a radially-inward force on the second partially-conical outer surface 350 by the inner surface 332 of the lower tubular member 318. The further downwell the sleeve 336 moves, the greater the force applied to the ball B by the trap 362. Downwell movement of the lower tubular member 318 is inhibited by contact of the shoulder 330 with the upper end surface 316 of the bottom connection 306.

Figure 16:
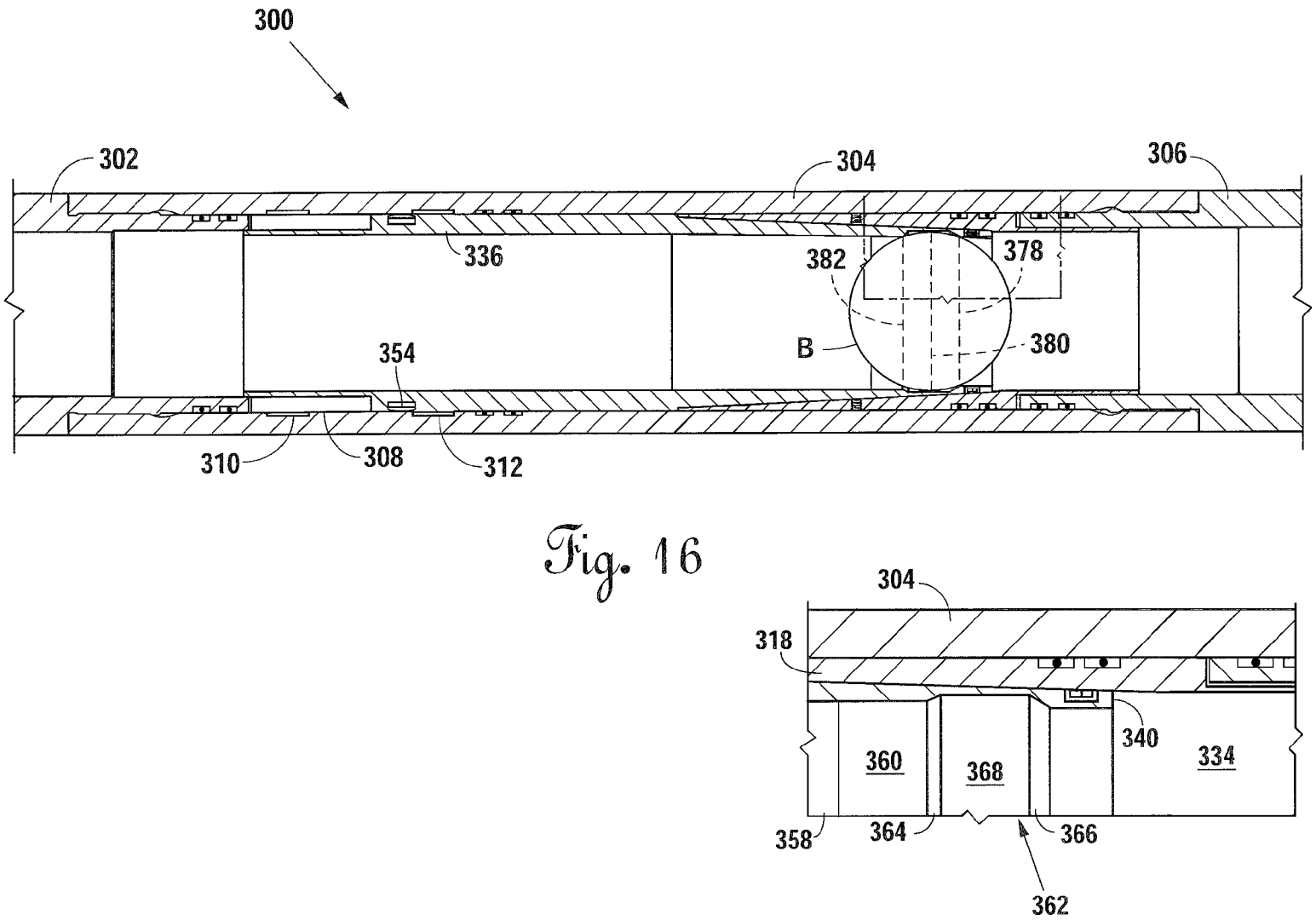
FIG. 16 shows the ball engaged with the ball trap of the third embodiment.

When moved to a second position as shown in FIG. 16, three rings of contact are applied to the ball. A lower contact ring 378 is caused by contact of the junction between the lower partially-conical surface 366 of the trap 362 and the lower side of the ball B. An intermediate contact ring 380 is caused by contact of the intermediate cylindrical surface 368 at the midline of the ball B. An upper contact ring 382 is caused by contact of the upper trap surface 364 and the upper side of the ball B. Engagement of the housing inner surface 308 by the ratchet ring 354 inhibits upwell movement of the sleeve 336.

Figure 17:
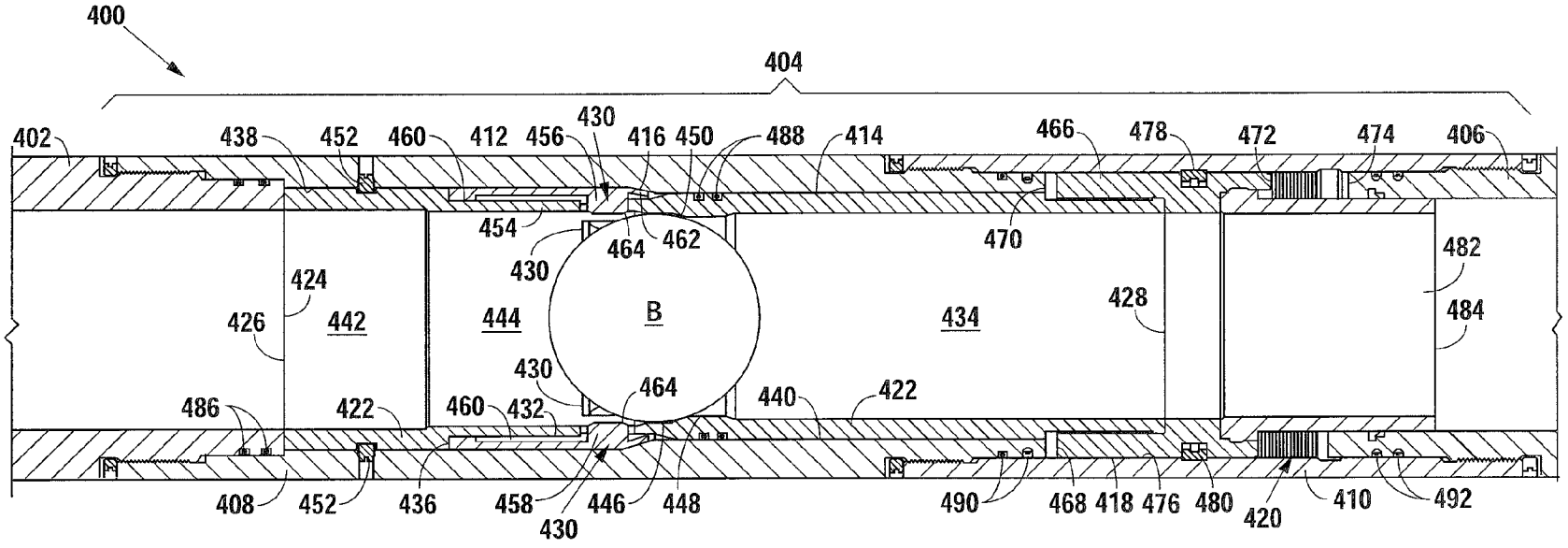
FIG. 17 is a side sectional view of a fourth embodiment.

FIG. 17 shows a fourth embodiment 400, which comprises a top connection 402, a housing assembly 404 connected to the top connection 402, and a bottom connection 406 connected to the housing assembly 404. The housing assembly 404 has an upper housing 408 and lower housing 410.

The upper housing 408 has a cylindrical upper inner surface 412 having a first ID, a cylindrical lower inner surface 414 having a second ID smaller than the first ID, and a partially-conical surface 416 adjacent to and between the upper and lower inner surfaces 412, 414. The lower housing 410 has a cylindrical inner surface 418, which has a locking portion 420 having a plurality of ridges or teeth extended radially inward therefrom.

A sleeve 422 is nested within the housing assembly 404. The sleeve 422 has an annular upper end surface 424 adjacent to a lower annular end surface 426 of the top connection 402, and an annular lower end surface 428. A plurality of circumferentially aligned slots 430 extends between an outer surface 432 and a cylindrical inner surface 444 of the sleeve 422. The sleeve 422 has an annular shoulder surface 436 between the upper end surface 424 and the slots 430. The sleeve outer surface 432 has an upper section 438 upwell of the shoulder surface 432 having a first OD, and a lower section 440 below the slots 430 having a second OD, which is smaller than the first OD. The lower section 440 is closely fitted to the second cylindrical lower inner surface 414 of the upper housing 408. The upper section 438 is closely fitted to the first cylindrical section 412.

The sleeve 422 includes a first cylindrical inner surface 442 having a first ID and a second cylindrical inner surface 444 having a second ID downwell of the first cylindrical surface 442. A third cylindrical inner surface 446 has a third ID and is positioned downwell of the slots 430. A fourth cylindrical surface has a fourth ID and is positioned downwell of the third cylindrical inner surface 446. A partially-conical surface 450 is adjacent to and between the third and fourth cylindrical surfaces 446, 448. A fifth cylindrical inner surface 434 has a fifth ID and is positioned downwell of the fourth cylindrical inner surface 448.

The sleeve 422 is fixed relative to the upper housing 408 with a plurality of shear pins 452. A collet 454 circumscribes the sleeve 422 and is longitudinally positioned between the upper section 438 and the lower section 440 of the sleeve outer surface. The collet 454 is further radially positioned between the inner surface 412 of the upper housing 408 and the outer surface 432 of the sleeve 422. The collet 454 has a central ring 456, lugs 458 extending radially inward from the central ring 456 through the slots 430, and a plurality of fingers 460 extending upwell from the ring 456 and contacting the annular shoulder surface 436. Kickers 462 extend downwell from the ring 456 opposite the fingers. The lugs 458 are longitudinally positioned upwell of the partially-conical inner surface 416 of the upper housing 408. Each lug 458 has a curved engagement surface 464, preferably corresponding to the curvature of a ball B optimally sized for use with the embodiment 400.

The adaptor 466 is fixed to the lower end of the sleeve 422 and has an annular upper end surface 468 adjacent to a lower end surface 470 of the upper housing 408. The adaptor 466 has an annular lower end surface 472, which is spaced a distance from the upper end surface 474 of the bottom connection 406. A cylindrical outer surface 476 extends between the upper and lower ends surfaces 468, 472. A groove 478 is formed in and circumscribes the outer surface 476 and is occupied by a lock ring 480 in a contracted state that is exerting a radially outward force against the inner surface 418 of the lower housing 410. A lower insert 482 is threaded to the lower end of the adaptor 466.

The lower insert 482 has a lower annular end surface 484 radially positioned within the bottom connection 406. A number of sealing elements positioned between the various elements inhibit fluid flow therebetween. A first pair of sealing elements 486 is positioned radially between the top connection 402 and the upper housing 408. A second pair of sealing elements 488 is positioned between the sleeve 422 and the upper housing 408, and moves with the sleeve 422. A third pair of sealing elements 490 is positioned between the upper and lower housings 408, 410. A fourth pair of sealing elements 492 is positioned between the bottom connection 406 and the lower housing 410.

Operation of the embodiment 400 is described with reference to a ball B, which has an OD equal to or slightly less than (preferably equal to) the third ID of the sleeve 422, but in any event no less than the fourth ID. The ball B enters the flowpath at the top connection 402 and migrates through the top connection 402 and sleeve 422 unabated until it reaches the third cylindrical surface 446. The ball B seats against the third cylindrical surface 446 and partially conical surface 450, allowing a well operator to increase pressure upwell of the ball B until shear pins 452 are fractured.

Thereafter, the sleeve 422 (and attached adaptor 466 and lower insert 482) is free to move relative to the housing assembly 404. Continued application of pressure to the ball B forces the sleeve 422 downwell, which in turn forces the collet 454 downwell as a result of contact between the shoulder surface 436 and the collet fingers 460. This downwell movement is inhibited by contact of the collet 454 with the partially-conical surface 416 of the upper housing 408. Continued application of pressure urges the collet ring 456 radially inward, causing the lugs to extend further through the slots 430.

As pressure is continually applied and increased, the collet ring 456 is forced into the volume defined by the second cylindrical section 414 of the upper housing 408, which causes the engagement surfaces 464 of the lugs 458 to contact the upwell side of the ball B. Thus, in this embodiment 400 a ball trap comprises the lugs 458 extending through the slots 430, and the third cylindrical surface 446 of the sleeve 422, and the adjacent partially-conical surface 450 of the sleeve 422. Throughout this process engagement of the lock ring 480 against the locking section 420 of the lower housing 410 inhibits inadvertent upwell movement of the adaptor 466, and therefore of the attached sleeve 422.

Figure 18:
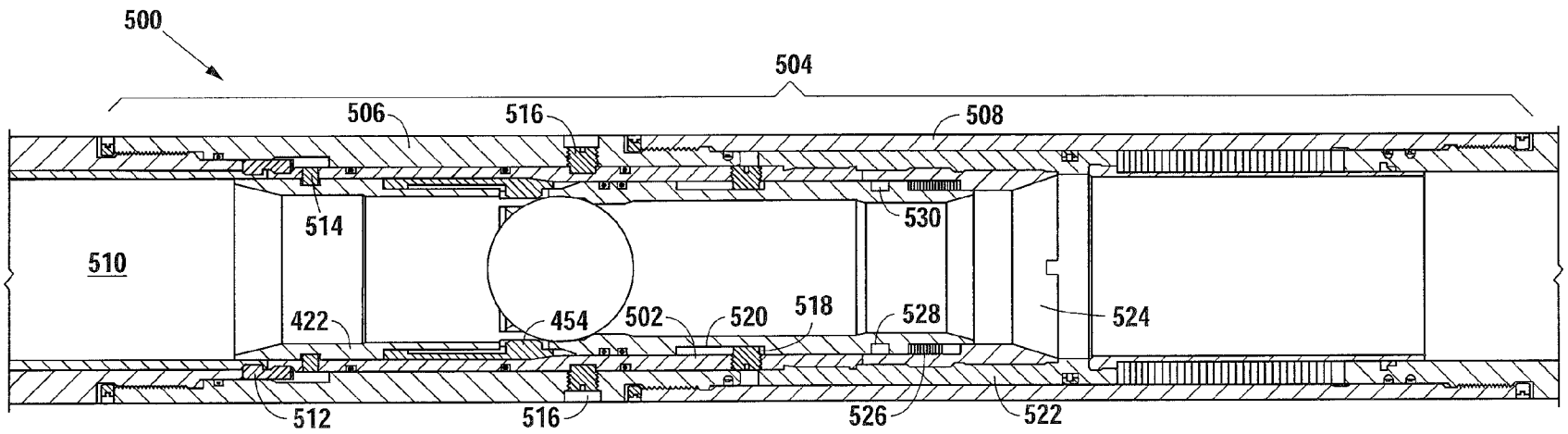
FIG. 18 is a side sectional view of a fifth embodiment.

FIG. 18 shows a fifth embodiment 500 of the present invention incorporating the principals shown in the fourth embodiment 400. The sleeve 422 and collet 454 are identical and function the same as in the fourth embodiment 400. The fifth embodiment 500 has an intermediary housing 502 radially positioned between an outer housing assembly 504 comprising an upper housing 506 and a lower housing 508. In addition, the intermediary housing 502 is attached to an actuating sleeve 510 with ring 512, which may be further attached to and cause actuation of another tool, in this case upwell of the embodiment 500.

In this embodiment 500, shear pins 514 initially fix the sleeve 422 to the intermediary housing. Intermediary housing 502 is further fixed to the upper housing 506 with a second set of shear pins 516. Torque pins 518 extend through the intermediary housing 502 into slots 520 formed in the sleeve 422. An adaptor 522 is threaded to the intermediary housing 502 and a ratchet housing 524. Ratchet housing 524 has a toothed inner surface 526 for engagement with a ratchet ring 528 disposed in a circumferential groove 530 around the sleeve 422.

The present disclosure includes preferred or illustrative embodiments in which specific tools are described. Alternative embodiments of such tools can be used in carrying out the invention as claimed and such alternative embodiments are limited only by the claims themselves. Other aspects and advantages of the present invention may be obtained from a study of this disclosure and the drawings, along with the appended claims.

We claim:

1. A downhole tool comprising:

a tubular housing having a first housing end, a second housing end, a housing inner surface, and a housing axis extending longitudinally between said first housing end and said second housing end;

a ball trap within said housing, said ball trap comprising, a first split ring with a first angular split ring surface and a second angular split ring surface;

a second split ring with a third angular split ring surface; and a ball carrier having a first angular carrier surface and a second angular carrier surface;

a first sleeve at least partially within said housing, said first sleeve having a first inner sleeve surface, an outer sleeve surface radially between said tubular housing and said inner sleeve surface, a first partially-conical sleeve surface longitudinally between the first housing end and the ball carrier, and an annular lip extending radially inward from said inner sleeve surface and opening toward said first housing end;

a second sleeve at least partially within said housing and having a second partially-conical sleeve surface longitudinally between the second housing end and the ball carrier, said second sleeve at least partially defining an annular space within said housing;

said ball trap positioned longitudinally between said lip and said second housing end; and a spring positioned in said annular space;

wherein, the first split ring engages the first partially-conical sleeve surface and the first angular carrier surface;

the second split ring engages the second partially-conical sleeve surface and the second angular carrier surface; and movement of the first sleeve toward the second sleeve causes the first split ring and the second split ring to contract, thereby reducing the inner diameter of the first split ring and of the second split ring.

2. The downhole tool of claim 1 with said ball carrier having a ball carrier inner diameter, a first restriction adjacent to said first angular carrier surface and having a first restriction inner diameter, and a second restriction longitudinally between said second angular carrier surface and said first restriction and having a second restriction inner diameter.

3. The downhole tool of claim 2 further wherein said first split ring has a first split ring inner diameter less than said first restriction inner diameter and said second split ring comprises a second split ring inner diameter less than said second restriction inner diameter.

4. The downhole tool of claim 1 further comprising a ball having a ball diameter and a center, said center longitudinally positioned within said ball carrier and wherein said first split ring has a first split ring inner diameter less than said ball diameter and said second split ring has a second split ring inner diameter less than said ball diameter.

5. The downhole tool of claim 1 wherein a pressure differential across the annular lip causes the first sleeve to move towards the second sleeve.

6. The downhole tool of claim 1 further comprising at least one locking ring, the at least one locking ring configured to hold the first sleeve in an actuated position.

7. The downhole tool of claim 6 wherein the at least one locking ring holds the first sleeve in position against force applied by the spring.

8. The downhole tool of claim 1 wherein the spring applies force to the second sleeve in the direction of the first sleeve.

9. A downhole tool comprising:

a tubular housing having a first housing end, a second housing end, a housing inner surface, and a housing axis extending longitudinally between said first housing end and said second housing end;

a ball trap within said housing, said ball trap comprising, a first split ring with a first angular split ring surface and a second angular split ring surface;

a second split ring with a third angular split ring surface; and a ball carrier having a first angular carrier surface and a second angular carrier surface;

a first sleeve at least partially within said housing, said first sleeve having a first inner sleeve surface, an outer sleeve surface radially between said tubular housing and said first inner sleeve surface, a first partially-conical sleeve surface longitudinally between the first housing end and the ball carrier, and an annular lip extending radially inward from said inner sleeve surface and opening toward said first housing end;

a second sleeve at least partially within said housing and having a second inner sleeve surface and a second partially-conical sleeve surface longitudinally between the second housing end and the ball carrier, said second sleeve at least partially defining an annular space within said housing;

said ball trap positioned longitudinally between said lip and said second housing end; and a spring positioned in said annular space;

wherein, the first split ring engages the first partially-conical sleeve surface and the first angular carrier surface;

a portion of the first split ring is positioned inside the first inner sleeve surface;

the second split ring engages the second partially-conical sleeve surface and the second angular carrier surface;

a portion of the second split ring is positioned inside the second inner sleeve surface; and further wherein movement of the first sleeve toward the second sleeve causes the first split ring and the second split ring to contract, thereby reducing the inner diameter of the first split and of the second split ring.

10. The downhole tool of claim 9 with said ball carrier having a ball carrier inner diameter, a first restriction adjacent to said first angular carrier surface and comprising a first restriction inner diameter and a second restriction longitudinally between said second angular carrier surface and said first restriction and comprising a second restriction inner diameter.

11. The downhole tool of claim 10 further wherein said first split ring has a first split ring inner diameter less than said first restriction inner diameter and said second split ring comprises a second split ring inner diameter less than said second restriction inner diameter.

12. The downhole tool of claim 9 further comprising a ball having a ball diameter and a center, said center longitudinally positioned within said ball carrier and wherein said first split ring has a first split ring inner diameter less than said ball diameter and said second split ring has a second split ring inner diameter less than said ball diameter.

13. The downhole tool of claim 9 wherein a pressure differential across the annular lip causes the first sleeve to move towards the second sleeve.

14. The downhole tool of claim 9 further comprising at least one locking ring, the at least one locking ring configured to hold the first sleeve in an actuated position.

15. The downhole tool of claim 14 wherein the at least one locking ring holds the first sleeve in position against force applied by the spring.

16. The downhole tool of claim 9 wherein the spring applies force to the second sleeve in the direction of the first sleeve.

* * * * *